US009491989B2

(12) United States Patent
Rivas

(10) Patent No.: US 9,491,989 B2
(45) Date of Patent: Nov. 15, 2016

(54) SHOELACE AND METHOD FOR FASTENING A SHOE USING SAME

(71) Applicant: Sergio Mauricio Rivas, Coronado, CA (US)

(72) Inventor: Sergio Mauricio Rivas, Coronado, CA (US)

( * ) Notice: Subject to any disclaimer, the term of this patent is extended or adjusted under 35 U.S.C. 154(b) by 0 days.

(21) Appl. No.: 14/871,693

(22) Filed: Sep. 30, 2015

(65) Prior Publication Data

US 2016/0015131 A1 Jan. 21, 2016

Related U.S. Application Data

(63) Continuation-in-part of application No. 13/854,088, filed on Mar. 30, 2013, now abandoned.

(51) Int. Cl.
*A43C 9/06* (2006.01)
*A43C 11/22* (2006.01)
*A43C 9/02* (2006.01)

(52) U.S. Cl.
CPC ..... *A43C 11/22* (2013.01); *A43C 9/02* (2013.01); *A43C 9/06* (2013.01)

(58) Field of Classification Search
CPC ..... A43C 9/00; A43C 9/02; A43C 9/04; A43C 9/06
USPC ..... 36/50.1
See application file for complete search history.

(56) References Cited

U.S. PATENT DOCUMENTS 1,142,199 A * 6/1915 Olson ..... A43C 9/00 24/129 D
1,669,537 A * 5/1928 Schaffer ..... A43C 7/00 24/712.4
4,247,967 A * 2/1981 Swinton ..... A43C 1/00 24/306
4,842,522 A * 6/1989 Alexander ..... A43C 9/00 24/712
5,016,327 A * 5/1991 Klausner ..... A43C 1/00 24/442
5,074,013 A * 12/1991 Arnold ..... A43B 1/0072 24/306
5,349,764 A * 9/1994 Posner ..... A43C 7/00 24/714.6
6,763,554 B1 * 7/2004 Torrey ..... B65D 63/10 24/17 AP
7,036,194 B2 * 5/2006 Tricker ..... A43C 9/06 24/713
2005/0044747 A1 * 3/2005 Doody ..... A43B 3/24 36/50.1
2005/0126041 A1 * 6/2005 Gonzalez Palacio A43B 3/0078 36/50.1
2008/0086910 A1 * 4/2008 Kim ..... A43C 11/1493 36/50.1
2010/0184349 A1 * 7/2010 Hernandez ..... A43B 3/0078 446/71

* cited by examiner

*Primary Examiner* — Marie Bays
(74) *Attorney, Agent, or Firm* — Donn K. Harms

(57) ABSTRACT

A shoelace device is disclosed having an elongated flexible section engaged on one end to an anchor. The elongated flexible section is configured for traversing apertures formed on opposite facings of a shoe. The anchor is sized with at least one dimension larger than the apertures to form a stop for preventing passage of the first end through an aperture. The anchor has a first fastening surface configured for removably joining in a first engagement to second fastening surface located on the flexible section when the second fastening surface comes into contact is the fastening surface. A second engagement of strap portions can be achieved using combination hook and loop fabric as the second fastening surface.

11 Claims, 6 Drawing Sheets

SHOELACE AND METHOD FOR FASTENING A SHOE USING SAME

This application is a Continuation-in-Part Application to U.S. patent application Ser. No. 13/854,088 filed on Mar. 30, 2013, which is incorporated in its entirety by this reference thereto. The present invention, in some embodiments thereof, relates to the field of clothing. More particularly, the disclosed device and method herein relate to shoes and shoe tying accessories.

BACKGROUND OF THE INVENTION

1. Field of the Invention

Commonly shoes are tied via laces threaded through a plurality of sequential apertures in the shoe which can be formed by eyelets. Conventionally, a single flexible lace is threaded through apertures centered within the eyelets (or hole if lacking eyelets) of the shoe, in a manner positioning both ends of the lace extending through the apertures in a top pair of eyelets (i.e., those in the eyelets that are farthest from the shoe's toebox) toward the outside of the shoe. These two free ends of the shoelace are then tied together to secure the shoe to the foot of the user. Both ends of the lace are generally fitted with rigid or semi-rigid aglets, which surround the respective laces at both distal ends. These aglets are engaged to provide some rigidity to the ends of the laces for easing the task of communicating the laces through the apertures in the plurality of sequentially positioned eyelets in the shoe.

When a new shoe is purchased, the user may sometimes have to initially position the laces through the shoes, by threading each of the laces through each of the apertures formed in the shoe itself, or in the plurality of eyelets of present. Even after the laces are joined to the shoes, the user generally has to tie the laces every time he or she puts on the shoes. This requirement for threading and tying the distal ends of each lace may be difficult tasks for children, people with disabilities, and people who suffer from arthritis and the like.

2. Prior Art

Many techniques and devices have been devised to simplify the act of securing shoes to a user's foot in order to eliminate or otherwise ease the requirement for lace tying. U.S. Pat. No. 4,270,285 discloses a shoe having an adjustable and flexible closure assembly utilizing separable fastening members having contacting, flexible gripping elements, such as hook and loop type mating fasteners in combination with an elastic instep-gore or elastic side-gores. The closure assembly includes an anchor strap having an opening to engage a fastener strap permitting the wearer to easily pull the uppers of the shoe inwardly and simultaneously to the precise desired tautness and fasten the shoe, using only one hand.

U.S. Pat. No. 4,210,983 discloses a shoe fastener for extending between cooperating pairs of eyelets of the shoe comprising: a flat resilient elongated member, and a pair of gripping members one covering substantially a different end of only one common surface of said resilient member and being bonded thereto along only terminal end parts of their lengths. The second parts of the lengths of said gripping members comprise an unbonded tab portions juxtapositioned to each other along the length of the resilient member. The ends of said resilient member include the gripping members when moved through an eyelet of a shoe causing the resilient member to separate from the associated gripping member along the unbonded portion thereof to form clamps for engaging the periphery of the associated eyelets of the shoe between the resilient member and the said second parts of the gripping members.

U.S. Pat. No. 4,553,293 relates to an improvement for tying devices which can be secured to laces particularly on shoes for holding the shoelace knot in place. The device disclosed in U.S. Pat. No. 4,553,293 employs a mechanism for securing a portion of the device to the shoe and enabling the device to be reused for securing a knot in place each and every time the laces are tied. In the embodiment disclosed U.S. Pat. No. 4,553,293, the invention also incorporates elastic or semi-rigid means for engaging the shoelace knot from opposed sides to impede the knot from becoming untied while simultaneously exposing the knot for view and maintaining the normal appearance of the bow.

BRIEF SUMMARY OF PREFERRED EMBODIMENTS OF THE INVENTION

The device of U.S. Pat. No. 4,270,285 is a fixed part of the shoe and quite expensive. U.S. Pat. No. 4,210,983 does not provide an easy fastening means for the shoe fastener. The device of U.S. Pat. No. 4,553,293 must be laced into the shoe laces and does not provide variable adjustment. There is, as such, an unmet need for a new device configured for engagement to and fastening of a shoe having a plurality of apertures positioned therein.

The present invention relates to a shoelace, or as can be discerned a shoelace replacement, which has a first and a second end, where the first end is joined to an anchor which is sized to prevent passage through a conventional aperture employed in shoes which can range from 1 mm to 8 mm. The anchor can be flexible so long as it prevents passage through the aperture of the shoe which abuts it, and optionally it can be rigid or semi-rigid anchor.

The anchor, sized larger than the aperture adjacent it through which the lace passes, will as such not fit through the aperture and thereby provides a means to anchor one end of the lace from pulling through the aperture in the shoe or an eyelet. The anchor includes a one half of a mating fastener adapted to removably engage with the body of a shoelace which includes or is formed off the mating half of the mating fastener.

In use, the shoelace of the present invention is to be threaded through at least a pair of apertures positioned in the shoe body itself or a pair of eyelets engaged with the shoe (which may or may not be at the same level) and which are located on opposite sides of the tongue of the shoe such that the fastener surface of the anchor which is sized to prevent passage through the apertures, partially or wholly covers one of the apertures in the show or eyelet and faces away from the shoe. On the same lace, the second end is threaded through a second aperture in the shoe or an eyelet on an opposing side of the tongue of the shoe. In this manner, the second end of the shoelace can be pulled toward the first end, to bring the two sides of the shoe closer to each other and tightening the engagement of the shoe upon the foot of the user.

One or a plurality of shoelace devices disclosed in the present invention may be operatively engaged in a single shoe. In such an engagement each shoelace is threaded through a corresponding pair of apertures in the shoe or eyelets. In this manner, the need for threading a single shoelace through a sequentially located plurality of eyelet pairs is obviated, and the process of tying the shoe is simplified.

Therefore, an aspect of some embodiments of the present invention relates to a shoelace comprising an elongated flexible section and engaged with an anchor at one end. The elongated flexible section has first end and a second end, the flexible section being configured for traversing one or a plurality of apertures in a shoe or eyelets engaged with a shoe. The anchor is joined to the first end of the flexible section of the lace, has at least one dimension sized larger than the size of the aperture in the shoe or eyelet through which the engaged flexible portion communicates, and is thereby configured for preventing passage of the first end of the lace through the aperture in the shoe or the eyelet. The anchor has a fastening surface configured for removably joining to a portion of the flexible section when the portion of the flexible section comes into contact is the fastening surface to thereby form a mating fastener from the two halves.

Currently, a preferred size of one dimension of all modes of the anchor disclosed herein, to prevent passage through an aperture of a shoe or eyelet adjacently engaged by the lace, will be between 1.5 mm and 8 mm depending on the size of the aperture to be blocked. Such apertures vary between 1 mm and 7.5 mm conventionally, depending on whether they are formed into the shoe or an eyelet engaged with the shoe, but could be outside this range. As such at least one dimension of the anchor will be sized with a distance of length or width between 1.5 and 8 mm with a current favored size being at least 3.6 mm.

In one variant mode of the lace device herein, the anchor may be formed rigid or semi-rigid.

In another variant, the anchor is configured for at least partially covering the eyelet.

In yet another variant, the fastening surface comprises a plurality of hooks configured for removably attaching to the flexible section.

In a further variant, the shoelace comprises an aglet joined to the second end of the flexible section.

The aglet may surround the second end of the flexible section.

Optionally, the aglet is rigid or semi-rigid.

Another aspect of some embodiments of the present invention relates to a shoe comprising a first facing, a second facing, and a shoelace. The first facing has at least a first aperture therein or through a first eyelet mounted therein. The second facing has at least one aperture therein through the shoe itself or through a second eyelet engaged with the shoe. The shoelace includes an elongated flexible section and an anchor engaged thereto at a first end. The elongated flexible section has first end and a second end, and is configured for traversing the first and second apertures in the shoe or the eyelets. The anchor is joined to the first end, has at least one dimension of a distance larger than at least the diameter of the first aperture, and is configured for preventing passage of the first end through the first aperture located in either the shoe or an eyelet engaged in the shoe. The anchor has a fastening surface configured for removably joining to a portion of the flexible section when the portion of the flexible section comes into contact is the fastening surface.

A further aspect of some embodiments of the present invention relates to a method for fastening a shoe employing a mode of the disclosed shoelace device herein, the method comprising: (i) providing a shoelace which comprises: an elongated flexible section having a first end and a second end, the flexible section being configured for traversing at least two apertures formed into the shoe or eyelets of the shoe; and having an anchor joined to the first end, the anchor having at least one dimension of a size larger than at least a diameter of a first one of the apertures and configured for preventing passage of the first end through the first aperture of the shoe or of an eyelet engaged therein, the anchor having a fastening surface configured for removably joining to a portion of the flexible section when the portion of the flexible section comes into contact is the fastening surface; (ii) threading the flexible section through the first aperture in the shoe or eyelet and a second aperture formed in the shoe or a second eyelet, the first aperture being located on a first facing of the shoe and the second aperture being located on a second facing of the shoe; (iii) pulling the flexible section to bring the anchor in contact with the first facing of the shoe; (iv) positioning the flexible section over the first aperture, toward the anchor; and (v) joining a portion of the flexible section with the anchor and with the hook and loop combination fabric positioned on facing first sides of the flexible section, joining the facing first sides in removable engagement.

In another particularly preferred mode of the device herein, a combination hook and loop fabric, such as OMNI-TAPE brand fasteners by VELCRO company is employed. This combination hook and loop fabric is positioned on at least one side surface of the flexible section between the first and second ends thereof. Combination hook and loop fabric has both the hook portion of the releasable fastener and the loop portion of the releasable fastener in a single layer of combination fastening fabric. Thus, any section of combination hook and loop fabric, will removably engage any other section of combination hook and loop fabric in which it comes in contact.

By placing combination hook and loop fabric, to substantially cover one side of the flexible section, when the flexible section is threaded through opposing apertures on opposite sides of the tongue of a shoe, the facing first side portions in-between the opposing apertures, will both have combination hook and loop fabric thereon. This placement on at least a first side of the flexible section, allows for the formation of a second removable engagement of the flexible section engaged in the shoe, because portions of the flexible section in the gap between the two sides hosting the apertures, may also be engaged to each other. This second engagement combined with the first engagement of hook and loop combination fabric to the hook or loop fabric positioned on the first side surface of the anchor has shown in experimentation, to yield a significant enhancement to the secure connection of the flexible portion in between opposing apertures by forming two engagements instead of just one.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE PREFERRED EMBODIMENTS OF THE INVENTION

The present invention is described herein in terms of example environments or an as-used engagement of the shoelace device herein secured through opposing apertures formed in a shoe or eyelets engaged in the shoe. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
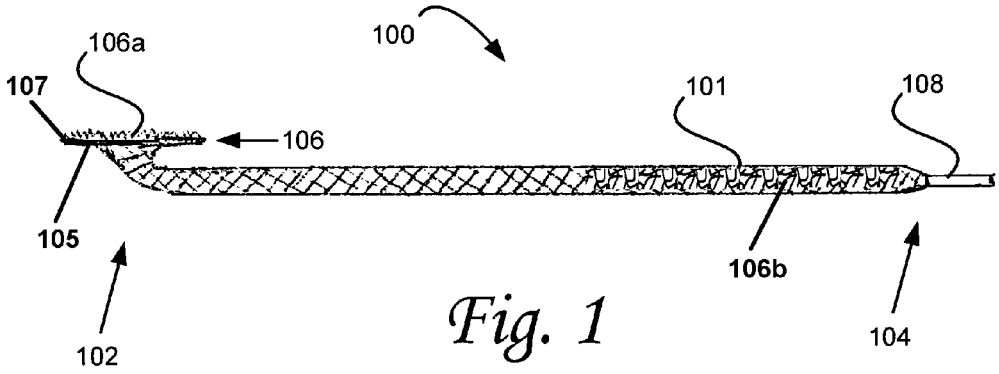
FIGS. 1 and 2 are drawings showing different views of a shoelace of the present invention.
Figure 2:
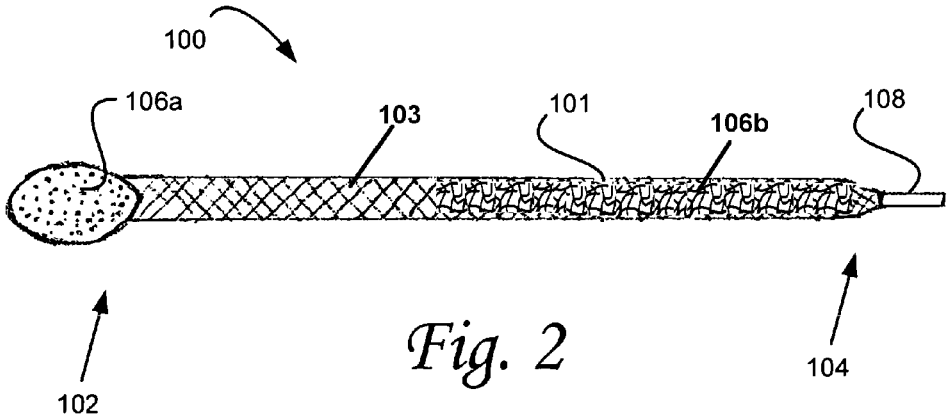

Referring now to the drawings of FIGS. 1-10, there is seen in FIGS. 1 and 2, schematic drawings showing different views of the device or shoelace 100 of the present invention. FIG. 1 shows a side view of one mode of the shoelace 100, while FIG. 2 shows a top view of the shoelace 100 of FIG. 1.

In all modes of the shoelace 100 device herein, the shoelace 100 has an elongated flexible section 101 having a first end 102 and a second end 104. The first end 102 of the flexible section 101 is joined to a middle area of a second side surface 105 of an anchor 106. The anchor 106 can be a flexible or rigid or semi-rigid element and has at least one fastener surface 106*a* engaged upon a first side surface 107 which is one half of a removably engageable fastener formed between the first side surface 107 of the anchor 106 and at least one side surface, such as on a first side 103 of the flexible section 101.

The first fastener surface 106*a* positioned to preferably cover the entire area of the first side surface 107 of the anchor 106, includes one half of an engageable fastener which is designed to removably join the first fastener surface 106*a*, with a mating second half or second fastener surface 106*b*, positioned upon at least one side such as the first side 103 of the flexible section 101. The removable fastener is formed when the first fastener surface 106*a* and the second fastener surface 106*b* on the flexible section 101 of the shoelace come into contact. It should be noted, that the strength of the contact between the material of the flexible section 101 and the fastener needed for joining the shoelace's material to the fastener depends on the properties of the fastener surface and the material of the flexible section 101. For example, in some cases, a slight touch between the second fastener surface 106*a* on a portion of the flexible section 101 and the first fastener surface 106*a*, may be enough to removably join the two together. In other cases, the portion of the flexible section 101 bearing the second fastener surface 106*b* may need to be pressed against the first fastener surface covering the first side surface 107 of the anchor 106, in order to achieve removable attachment between the two.

The removably engageable fastener may be a releasable adhesive, however, more preferably it is formed of an engagement between a hook and a loop fastener, or in a particularly preferred mode of the device herein, it can be formed of a combination hook and loop fastener material as noted below. In the latter case, if a combination hook and loop fastener material is not employed, then the first side surface 107 of the anchor would be covered by hook or loop fabric, and at least one side of the flexible section 101, would have positioned thereon the other one of the hook or loop fabric which is not engaged upon the first side surface 107 of the anchor 106. Currently, placement of hook fabric as the first fastening surface 106*a* upon the first side surface 107 of the anchor 106, and loop fabric for the second fastener surface 106*b* upon a side of the flexible section 101 is preferred for ease of manufacturing. More preferably, combination hook and loop fastener material such as OMNI-TAPE brand fasteners by the VELCRO company, is engaged on one entire side surface between the first end 102 and second end 104 of the flexible section 101, so as to form a first removable engagement when in contact with the first fastening surface 106*a* covering the anchor 106, and a second removable engagement of facing portions of the combination hook and loop fabric within the gap 111 between the opposing apertures 201 formed in the surface of the shoe, or in opposing eyelets 202 situated across the gap 111.

The anchor 106 has a length and a width defining an area of the anchor 106 which is sized to have at least one dimension of the length or width larger than the apertures 201 formed in the shoe or eyelets 202 of the shoe through which the shoelace 100 is meant to communicate for use. Currently forming at least one dimension of the length or width of the anchor 106 having a distance between 1.5 mm and 8 mm is preferred as the apertures 201 conventionally vary between 1 mm and 7.5 mm in many shoes. A favored distance of the one dimension of the anchor 106, for most shoes, would be at least 3.5 mm as the diameter of most apertures 201 formed in shoe eyelets 202 or the surface of the shoe, have been found in experimentation to be smaller than that dimension. In this manner, the anchor 106 is rendered large enough so that it does not fit within the aperture 201 of a shoe or eyelet 202 of the shoe thereby preventing the first end 102 of the shoelace 100 engaged thereto, from communicating through the aperture 201 once the second end 104 of the shoelace has been threaded therethrough. In a variant, the anchor 106 is configured for wholly or partially covering the eyelet of the shoe. A preferred shape of the anchor 106 as in FIGS. 7-10, is rectangular, with the first side surface 107 being covered entirely by a first fastening surface 106*a*, which has been found in experimentation to yield the most secure first engagement between the fastening surfaces of the anchor and flexible section 101. However, optionally, the shape of the first side surface 107 of the anchor 106 and first fastener surface 106*a* covering it may be oval or circular. The shape of the fastener surface and anchor 106 is not limited to the mentioned shapes, and they may be manufactured to have any desired shape such as may be the case where fashion tastes are involved.

Optionally, but preferred for ease of threading through the apertures of the shoe, the second end 104 of the flexible section 101 is joined to (e.g. surrounded by) a rigid or semi-rigid aglet 108 at the second end 104 thereof. The aglet 108 imparts some rigidity to the second end 104 of the flexible section 101, in order to ease the passage thereof through the apertures 201 formed in the shoe or engaged eyelets 202. Optionally, the aglet 108 compresses the second end 104 in order to decrease a cross sectional surface of the second end, further easing the shoelace's passage through the opposing apertures 201 to engagement in an as-used position across the gap 111.

The flexible section 101 may be made of any suitable material known in the art, such as leather, cotton, jute, hemp, and/or synthetic fiber, such as nylon, for example. The flexible section 101 may include on the first side 103 or be in the form of the second fastening surface 106*b*, such as loop material or combination hook and loop material, between the connection to the central portion of the anchor 106 and the second end 104. All these materials may function as loop-sections of a hook-and-loop fastener. The aglet may be made of adhesive tape, wax, resin, glue, thread, heat shrink or metal tubing. Instead of the aglet, the second end 104 of the shoelace may be simply knotted or melted. The anchor 106 may be made of any rigid or semi-rigid material, such as plastic, metal, wood, cardboard, etc.

The length of the flexible section 101, and the size and geometry of the formed fastener and of the aglet (if present) are chosen according to the shoe with which the shoelace 100 is meant to be used. Such will depend on the spacing of the apertures 201 in the shoe or in the engaged eyelets 202, as well as the diameter of those apertures 201. An aglet which compresses the second end 104 of the shoelace 100 such that it will easily traverse through the diameter of the apertures 201 in the shoe or the eyelets 202 in the shoe is preferred to as to ease the communication of the second end 204 through both opposing apertures 201 situated across the gap 11 to engage the device herein to the as-used position shown for example in FIGS. 3*b*, 4*b*, and 10.

Figure 3A:
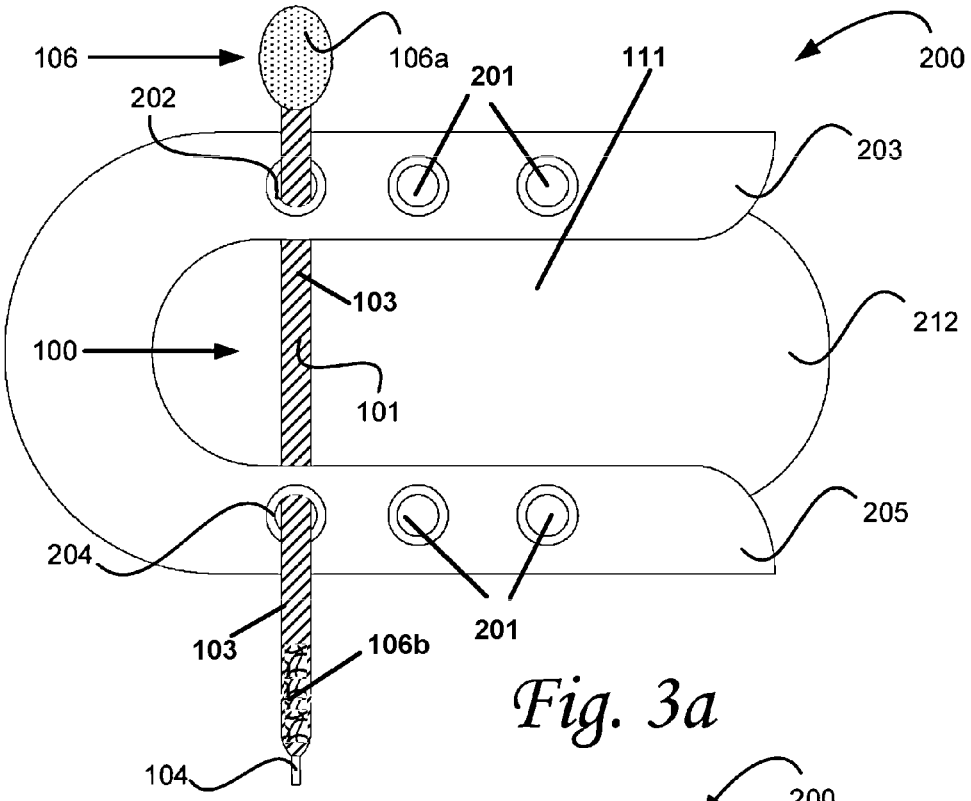
FIGS. 3*a* and 3*b* are schematic drawings illustrating a first manner in which the shoelace of the present invention may be inserted through a pair of opposing apertures formed in eyelets, and engaged across a gap in an as-used position, for securing a shoe to the user's foot.
Figure 3B:
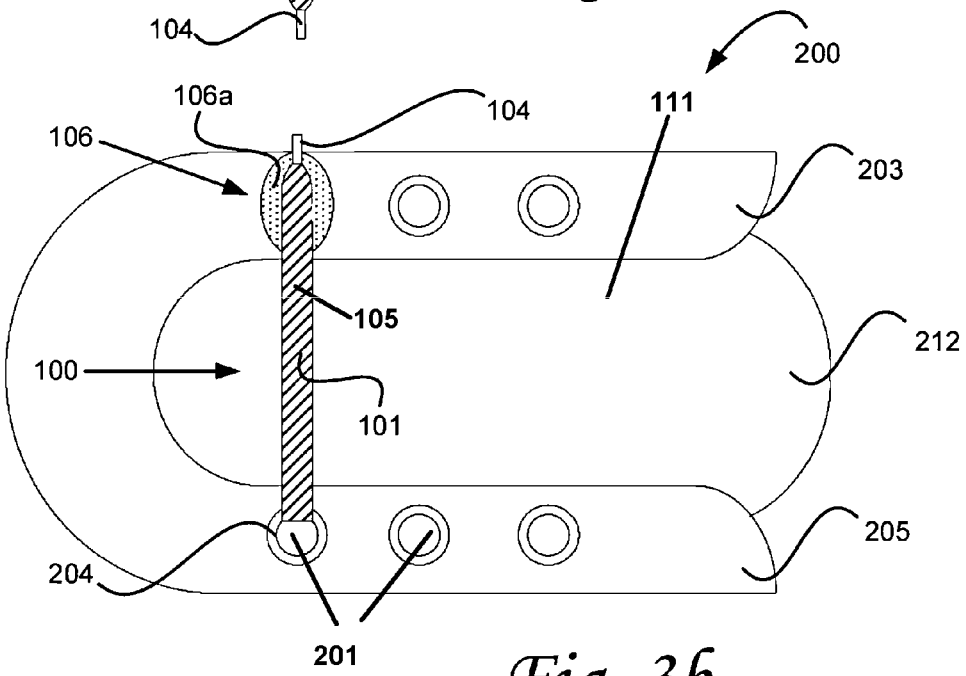

FIGS. 3*a* and 3*b* are schematic drawings illustrating a first manner in which the device or shoelace 100 of the present invention may be inserted into a pair of apertures 201 formed within eyelets 202, and used for securing a shoe 200 to the user's foot. As shown in FIG. 3*a*, the flexible section 101 is configured for traversing a pair of apertures 201 communicating through a pair of eyelets 202 and 204 located on respecting facings 203 and 205 of the shoe (e.g. on opposing sides of the gap 111 occupied by the tongue 212, if present). The second end 104 of the flexible section 101 is threaded through both apertures 201 of both eyelets 202 and 204. The anchor 106 is sized as noted above to be larger than the diameter of the apertures 201 and consequently cannot traverse the aperture 201 of the first eyelet 202, and thus anchors the shoelace 100 to the first facing 203 defining one side of the gap 111.

As shown in FIG. 3*b*, after exiting a second aperture 201 in a second eyelet 204, the second end 104 of the flexible section 101 may be pulled toward the anchor 106, to pull the first and second facings 203 and 205 which define the gap 111, toward each other and thus tighten the shoe around the user's foot. Once the user is satisfied with the tightness of the shoe, the flexible section 101 is rotated about second aperture 111 communicating through the second eyelet 204, so that the second end 104 portion of the shoelace is moved toward the first fastener surface 106*a* covering the first side surface 107 of the anchor 106. In this manner, a portion of the flexible section 101 bearing the second fastening surface 106*b*, is brought into contact with and joined to the first fastener surface 106*a*, and the tightness of the shoe around the user's foot is maintained.

It should be noted that though the example of FIGS. 3*a* and 3*b*, the apertures 201 and eyelets are aligned with each other (set at the same height along the respective facings), this is not a necessity. In fact, the flexible section 101 may be communicated across the gap 111 and set diagonally to traverse two apertures 201 that are not aligned with each other.

Figure 4A:
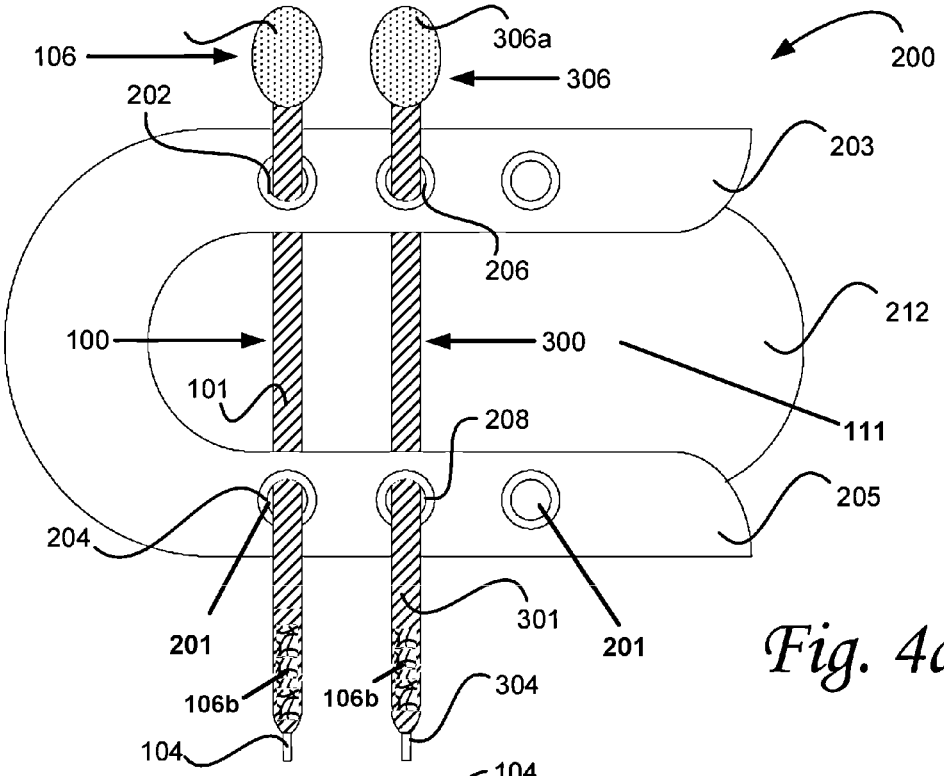
FIGS. 4*a* and 4*b* are schematic drawings illustrating a second manner in which the shoelace of the present invention may be inserted into a pair of opposing apertures formed in eyelets, and used for securing a shoe to the user's foot.
Figure 4B:
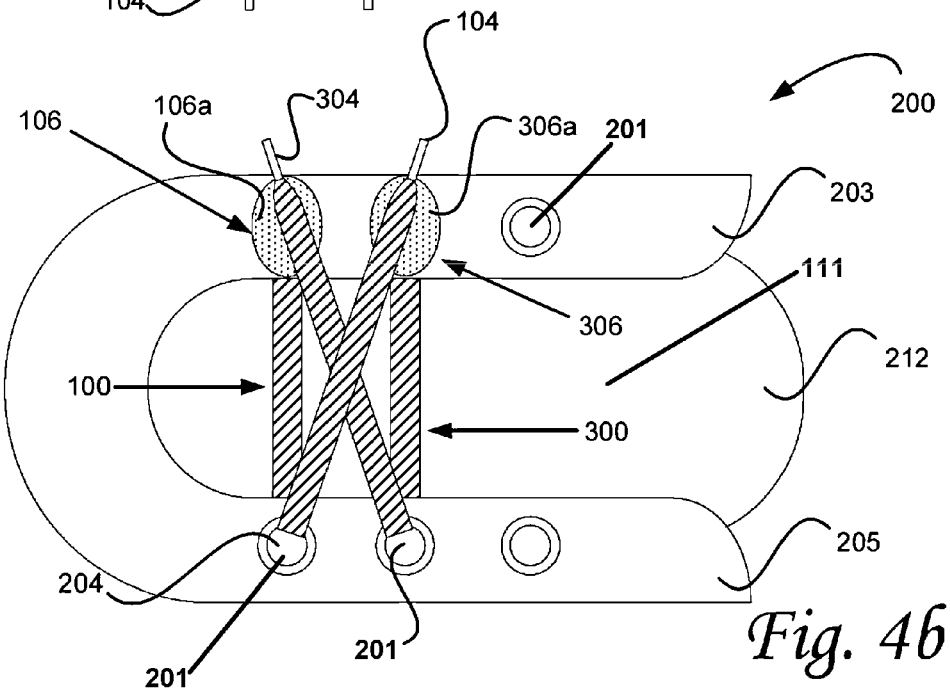

FIGS. 4*a* and 4*b* are schematic drawings illustrating a second manner in which the shoelace 100 of the present invention may be inserted into a pair of apertures 201 in the shoe or in eyelets, and used for securing a shoe 200 to the user's foot.

As shown in FIG. 4*a*, two shoelaces of the present invention are present. The first shoelace 100 includes the first flexible section 101 having a first end 102 and a second side 104, and the first anchor 106 joined to a first end 102 of the first flexible section 101. The first anchor 106 has a first fastener surface 106*a* covering the entire area of the first side surface 107. The second shoelace 300 includes a second flexible section 301 having a first end and a second end 304, and a second anchor 306 joined to a first end of the second flexible section 301. The second anchor 306 has a second fastener surface 306*a* positioned on a first side surface. The first flexible section 101 traverses the aperture 201 in the first eyelet 202 on the first facing 203 and the second aperture 201 in the second eyelet 204 on the second facing 205, and is anchored to the first facing 203 via the first anchor 106. The second flexible section 301 traverses an aperture 201 in a third eyelet 206 on the first facing 203 and an aperture 201 formed in a fourth eyelet 204 on the second facing 205, and is anchored to the first facing 203 via the second anchor 306.

As shown in FIG. 4*b*, the second end 104 of the first flexible section 101 is pulled toward the second anchor 306, thus joining a second fastening surface 106*b* on all or the shown portion of the first flexible section 101 to the second anchor 306 of the second shoelace 300. Similarly, the second end 304 of the second flexible section 301 with the second fastening surface 106*b* thereon is pulled toward the first anchor 106, thus joining a portion of the second flexible section 301 to the first fastening surface 106*a* covering the first side surface 107 of the first anchor 106 of the first shoelace 100. The facings 203 and 205 are still brought closer to each other and the gap 111 slightly narrowed in portions thereby securing the shoe 200 around the user's foot.

Figure 5:
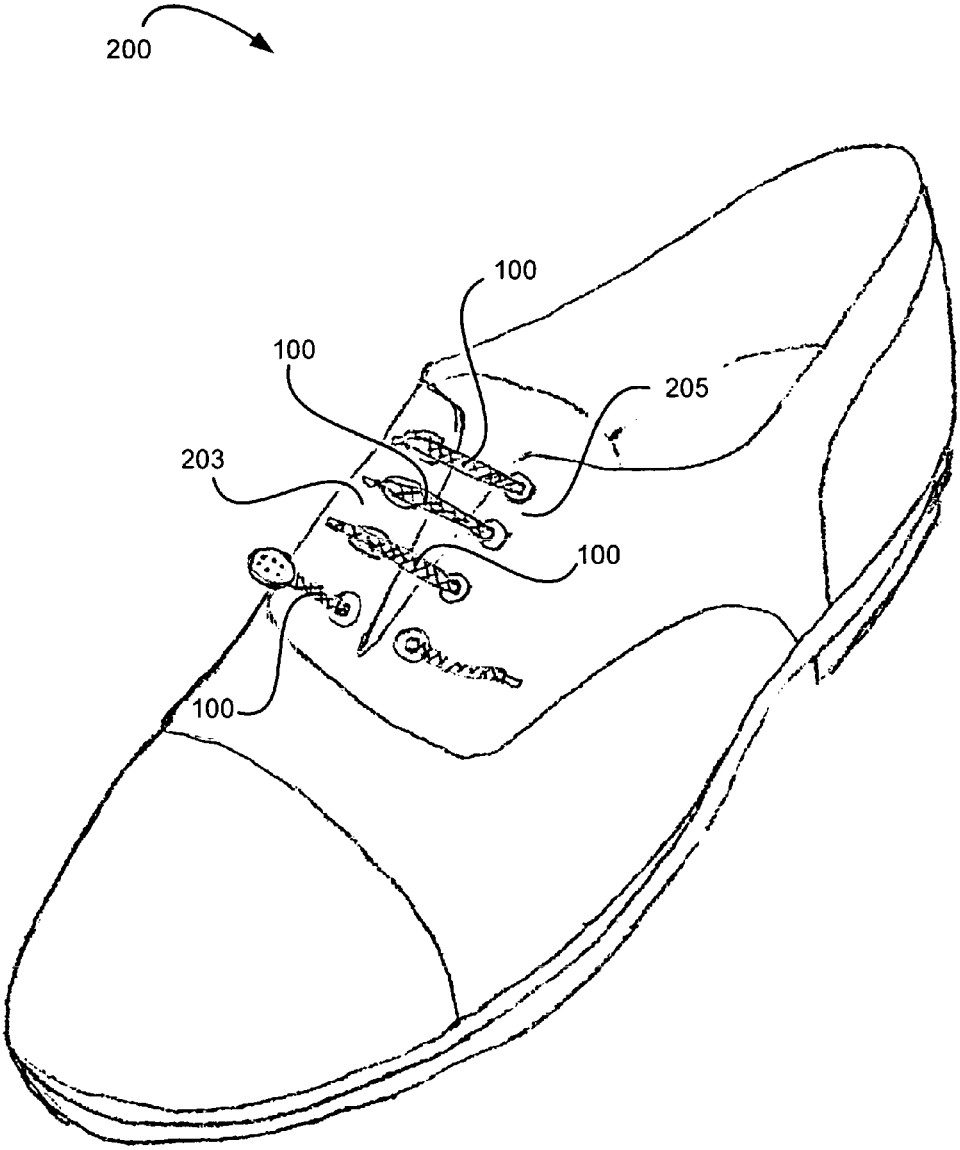
FIG. 5 is a perspective drawings illustrating an example of a dress shoe fitted with a plurality of the shoelaces of the present invention in as-used positions secured across the gap occupied by the tongue of the shoe.

FIG. 5 is a perspective drawing illustrating an example of a dress shoe fitted with a plurality of the shoelaces engaged in respective as-used positions through opposing apertures of the present invention.

A plurality of shoelaces 100 of the present invention are used for securing the dress shoe 200 to the user's foot. The flexible section of each shoelace traverses a respective pair of apertures 201 formed in the depicted eyelets, where the first eyelet of the pair is located on the first facing 203 while the second eyelet of the pair is located on the second facing 205. Optionally, the aperture or apertures in the eyelets of the pair are set at the same height along the respective facings.

In a variant, the shoelaces 100 include respective aglets, each aglet located at the second end of the respective shoelace's flexible section. Optionally, all the shoelaces 100 are anchored at the first facing 203, so that a second end of flexible section is joined to the same shoelace's fastener surface located on the first facing 203.

Figure 6:
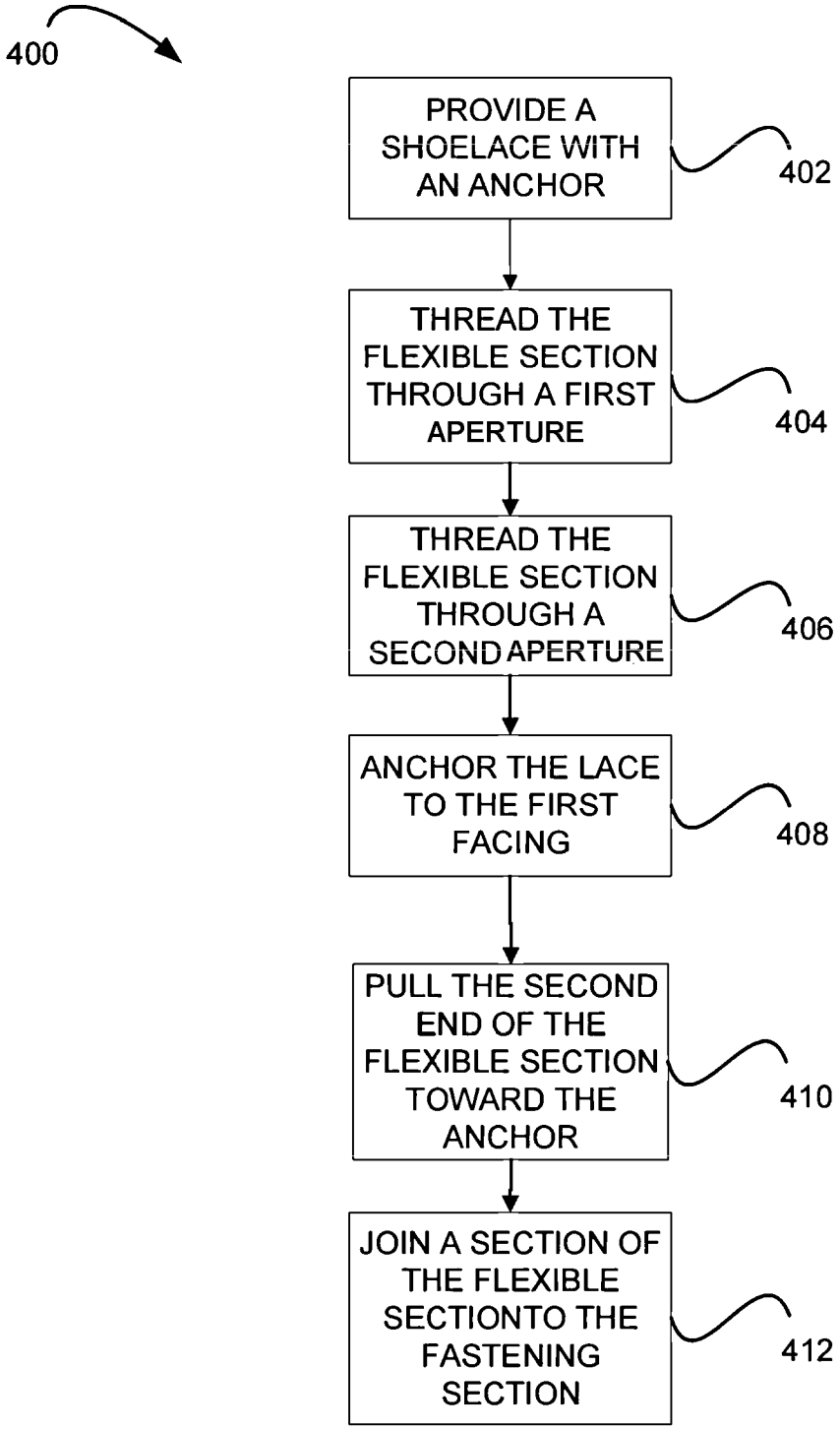
FIG. 6 is a flowchart illustrating a method for securing a shoe to a foot, using the shoelace of the present invention.

FIG. 6 is a flowchart 400 illustrating a method for securing a shoe to a foot, using the shoelace of the present invention.

At 402, a shoelace of the present invention as described above is provided. At 404, the second end of the shoelace's flexible section is threaded through a first aperture of a shoe located on the shoe's first facing. At 406, the second end of the shoelace's flexible section is threaded through a second aperture of the shoe located on the shoe's second facing.

At 408, the second end of the shoelace's flexible section is pulled so that the anchor contacts the first facing of the shoe, thus anchoring the shoelace to the first facing. At 410, the second end of the shoelace's flexible section is pulled over the first facing toward the anchor, in order to pull the first and second facings toward each other and tighten around the user's foot. At 412, while the shoelace's flexible section is still taut, a portion of the shoelace's flexible section is joined to the fastening surface of the anchor. In this manner the tightness of the shoelace's flexible section is maintained, and therefore, the shoe is secured to the user's foot.

Figure 8:
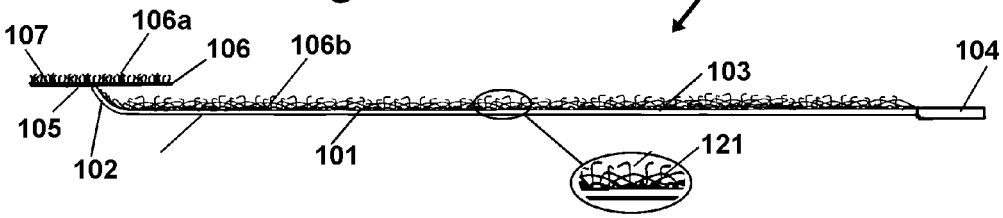
FIG. 8 shows a side view of the anchor of the device of FIG. 7, showing the combination hook and loop fabric positioned on the first side of the flexible portion and an enlarged section thereof, and showing mating hook or hook and loop combination fabric preferably covering the entire first side surface of the anchor, which is engaged to the first end of the flexible portion at a mid point on the second side surface of the anchor.
Figure 9:
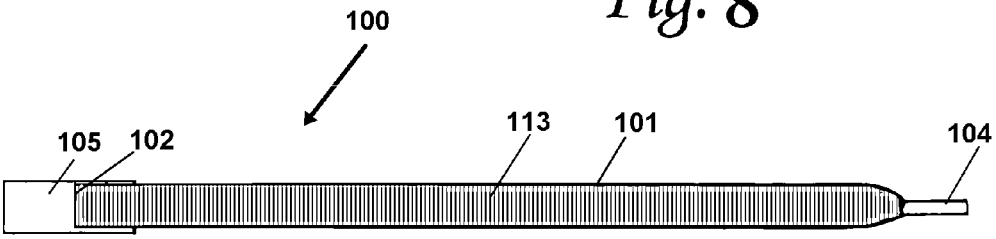
FIG. 9 depicts an overhead view of the second side surface of the anchor and the second surface of the flexible portion, and the engagement of the flexible portion at a central position on the second side surface of the anchor, to thereby provide means to center the long dimension of the anchor over an aperture in a shoe when the flexible portion is communicated therethrough.
Figure 10:
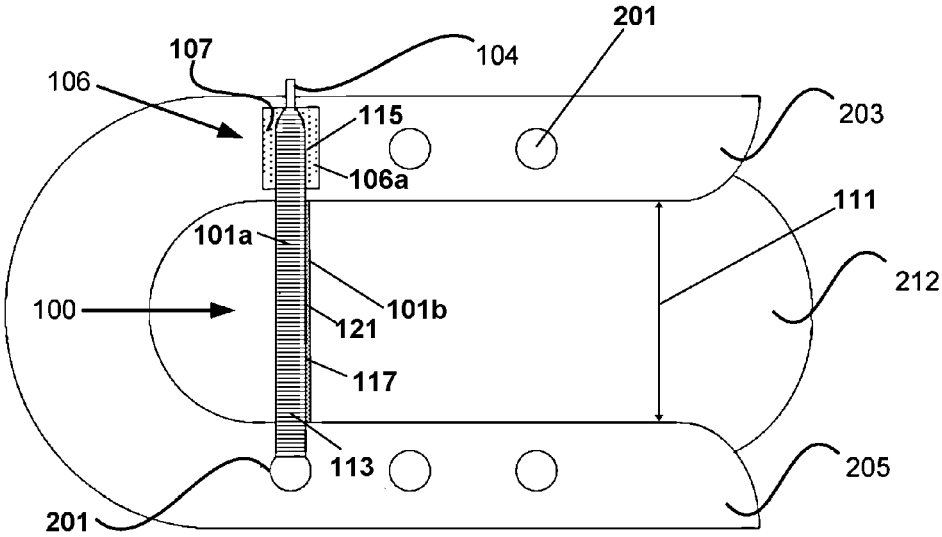
FIG. 10 shows the device of FIGS. 7-9 engaged on a shoe, where the second end of the flexible portion has been threaded through opposing apertures positioned across a gap, and where one section of the first side of the flexible portion is engaged with a second section of the first side of the flexible portion, and the second end of the flexible portion is engaged to the first side surface of the anchor, thereby yielding two engagements of the flexible portion for a more secure mount to the shoe.

Shown in FIGS. 7-10 is a particularly preferred mode of the shoelace 100 device herein, yielding first and second engagements of the flexible portion 101 when engaged to the as-used position shown in FIG. 10. As shown in FIG. 10, a first engagement 115 of the flexible section 101 is achieved by engagement of the first fastening surface 106*a* covering the first side surface 107 on the anchor 106, to a second fastening surface 106*b* positioned on a first side 103 of the flexible section 101. A second engagement 117 is achieved by engagement of a first portion 101*a* of the flexible section 101 and a second portion 101*b* of the flexible section 101 in the area of the gap 111. This second engagement 117 is achieved by the placement of combination hook and loop fabric 121 as the second fastening surface 106*b*, across the length of a first side 103 of the flexible section 101 as the combination hook and loop fabric will engage itself, as well as any of hook, loop or combination hook and loop fabric placed on the first side surface 107 of the anchor 106. This mode of the device herein, by providing both a first and second removable engagement to secure the flexible section 101 in the as-used position, yields a particularly secure engagement found to be much more unlikely to disconnect when the user is running or exercising or the shoes are bumped or otherwise contacted, than a single engagement.

Figure 7:
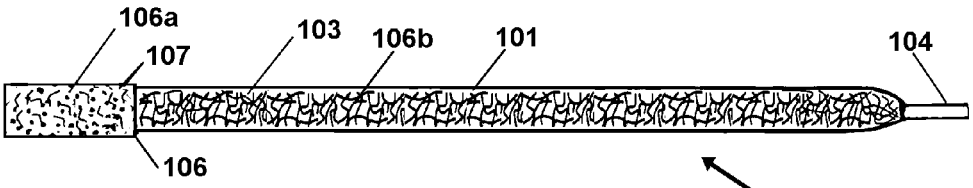
FIG. 7 depicts an overhead view showing a first side surface of the anchor having hook fabric, loop fabric, or combination hook and loop fabric thereon, and a first side of a flexible portion of the shoelace device herein, having combination hook and loop fabric positioned thereon between the first and second ends of the flexible portion.

FIG. 8 shows a side view of the anchor of the shoelace 100 device of FIG. 7, showing the combination hook and loop fabric 121 in an enlarged section, which may be employed as the second fastening surface 106*b* positioned on the first side 103 of the flexible section 101 of the device herein shown. Also shown are the preferred engagement of the first end 102 of the flexible section 101 to a central area of the second side surface 105 of the anchor 106 which as noted has been shown to center the anchor 106 with the aperture 201 and in the case where the anchor 106 is rectangular as shown in FIGS. 7-10, positioning the engagement of the first end 102 to the anchor 106 in the central area has also been found to cause the anchor 106 to align axially with the flexible section 101 communicating across the gap 111 be it straight across or diagonally as in FIG. 4*b*.

FIG. 9 depicts an overhead view of the second side surface 105 of the anchor and second side 113 of the flexible section 101 and the engagement of the first end 102 of the flexible section 101 at a central position on the second side surface 105 of the anchor 106. Such an attachment as noted provides means to center the anchor 106 over an aperture 201 in a shoe when the flexible portion is communicated therethrough, and in the case of a rectangular shaped anchor 106 having a long axis aligned with the axis of the flexible section 101, this central connection has shown to better align the rectangular anchor 106 with the axis of the flexible section 101 when stretched and secured in the as-used position.

As noted above, FIG. 10 shows the device of FIGS. 7-9 engaged on a shoe where the second end 104 of the flexible section 101 has been threaded through opposing apertures 201, and where a first portion 101*a* of the flexible section 101 is engaged across the gap 111 with a second portion 101*b* of the flexible section 101. As noted when combination hook and loop fabric 121 is engaged to the first side 103 of the flexible section 101, this second engagement 117 may be achieved along with the above noted first engagement 115 to provide a much more secure engagement of the shoelace 100 device to the shoe, than just a single engagement at the first fastening surface 106*a* covering the first side surface 107 of the anchor 106.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A shoelace configured for an as-used positioning secured between two opposing apertures positioned on opposite sides of a gap in a shoe, comprising:

an elongated flexible section having a first end and having a second end, the flexible section being configured for traversing through a pair of opposing apertures formed in shoe;

an anchor in an attachment at the first end of said flexible section, the anchor having a length extending between opposing ends of said anchor and having a width in between opposing sides, defining an area of a first side surface, said anchor having a second side surface on an opposite side of said anchor from said first side surface;

said anchor forming a stop for preventing passage of said first end connected thereto, through said apertures; and a first fastening surface positioned on the first side surface of the anchor, said first fastening surface configured to removably engage with a second fastening surface located on a first side surface of said flexible section in a first engagement, upon a contact of said second fastening surface against said first fastening surface, whereby said shoelace positioned to an as-used position, with said second end of said flexible section communicated through both of said apertures, and positioned with said second fastening surface engaged with said first fastening surface, secures the shoe to a foot of a user.

2. The shoelace of claim 1, wherein said engagement of said anchor to said first end of said flexible section, is an engagement located at a central position inbetween said opposing ends and in between said opposing sides, on said second side of said anchor.

3. The shoelace of claim 1, wherein said first fastening surface located upon said first side surface of said anchor is formed of one of hook fabric or loop fabric; and the second said second fastening surface is formed of the other of said hook fabric or said loop fabric than that forming said first fastening surface.

4. The shoelace of claim 2, wherein said first fastening surface located upon said first side surface of said anchor is formed of one of hook fabric or loop fabric; and the second said second fastening surface is formed of the other of said hook fabric or said loop fabric than that forming said first fastening surface.

5. The shoelace of claim 3, wherein loop fabric covers a first side surface of said flexible section in-between said first end and said second end thereof.

6. The shoelace of claim 4, wherein loop fabric covers a first side surface of said flexible section in-between said first end and said second end thereof.

7. The shoelace of claim 1, wherein said first fastening surface located upon said first side surface of said anchor is formed of one of hook fabric or loop fabric;

the second said second fastening surface is formed of combination hook and loop fabric; and said second fastening surface forming a second engagement adapted for positioning within a gap between said apertures upon said opposite sides of a said gap in a shoe, said second engagement being a removable engagement between said combination hook and loop fabric on a first portion of said flexible section, and said combination hook and loop fabric located on a second portion of said flexible section.

8. The shoelace of claim 2, wherein said first fastening surface located upon said first side surface of said anchor is formed of one of hook fabric or loop fabric;

the second said second fastening surface is formed of combination hook and loop fabric; and said second fastening surface forming a second engagement adapted for positioning within a gap between said apertures upon said opposite sides of a said gap in a shoe, said second engagement being a removable engagement between said combination hook and loop fabric on a first portion of said flexible section, and said combination hook and loop fabric located on a second portion of said flexible section.

9. The shoelace of claim 1, wherein said length is between 1.5 and 8 mm.

10. The shoelace of claim 1, wherein said length is at least 3.6 mm.

11. A method for fastening a shoe employing the shoelace of claim 7, the method comprising:

I. providing said shoelace;

ii. threading the flexible section through the first aperture located on a first facing of the shoe and the second aperture being located across a gap and on a second facing of the shoe;

iii. pulling the flexible section to bring the anchor in contact with the first facing of the shoe;

iv. rotating the flexible section over the second aperture, toward the anchor; and v. joining a portion of the flexible section with the anchor in a first engagement; and vi. joining said first portion of said flexible section to said second portion of said flexible section to form said second engagement.

* * * * *